US006345751B1

(12) United States Patent
Elliot

(10) Patent No.: US 6,345,751 B1
(45) Date of Patent: Feb. 12, 2002

(54) METHOD AND APPARATUS FOR CARRYING A PORTABLE ELECTRONIC DEVICE

(76) Inventor: Robert Nolan Elliot, 1480 Cole Rd., Aromas, CA (US) 95004

( * ) Notice: Subject to any disclaimer, the term of this patent is extended or adjusted under 35 U.S.C. 154(b) by 0 days.

(21) Appl. No.: 09/632,403

(22) Filed: Aug. 4, 2000

(51) Int. Cl.[7] ..... A45F 3/04

(52) U.S. Cl. ..... 224/646; 224/640; 224/930; D3/218

(58) Field of Search ..... 224/637, 640, 224/664, 646, 649, 930; D3/218; 455/351

(56) References Cited

U.S. PATENT DOCUMENTS 2,676,738 A * 4/1954 Herrick
4,489,770 A * 12/1984 Reich, II
5,409,152 A * 4/1995 Trevino
5,579,966 A * 12/1996 Krumweide et al.
5,711,469 A * 1/1998 Gormley et al. ..... 224/930 X
5,909,834 A * 6/1999 Parrot, III
6,006,915 A * 12/1999 Moor
D434,897 S * 12/2000 Hillman ..... D3/218
D436,723 S * 1/2001 Ankri ..... D3/218

* cited by examiner

*Primary Examiner*—Gregory M. Vidovich
(74) *Attorney, Agent, or Firm*—Donald R. Boys; Central Coast Patent Agency, INC

(57) ABSTRACT

A personal carrier for carrying an electronic device in front of a user's upper body has a carrier body having an opening with a closure for inserting and withdrawing the electronic device, a body strap system attached to opposite edges of the carrier body, for passing around a user's upper body, placing the body against the user's front, upper body area, and a shoulder strap system attaching to the carrier body, having a portion passing over each of a user's shoulders, and joining to the body strap system at a position in the user's mid-back area with the carrier body positioned in the user's front, upper body area. Adjustment and separation mechanisms are provided in the straps, and the carrier can be of a wide variety of materials and designs.

8 Claims, 3 Drawing Sheets

METHOD AND APPARATUS FOR CARRYING A PORTABLE ELECTRONIC DEVICE

FIELD OF THE INVENTION

The present invention is in the field of carrying cases for portable electronic devices, and has particular application in providing an improved method and apparatus for carrying a CD player or similar device.

BACKGROUND OF THE INVENTION

Music is art concerned with combining vocal or instrumental sounds for beauty of form or emotional expression, usually according to cultural standards of rhythm, melody, and, in most Western music, harmony. Conceptual and auditory factors have been present in music of all styles and in all periods of history, Eastern and Western, permeating in one guise or another into every human society.

The ability to carry the music along while traveling from one place to another has been a time-honored tradition for individuals belonging to cultures of modern times. Some examples of methods used are to carry along a harmonica or similar small musical device in the pocket, or a fiddle or flute contained within a protective carrying case. Many other methods have been developed over time for transporting musical apparatus between destinations, while at the same time having the ability to enjoy the music during travel.

With the advance of electronic music technology, developed late in the 17th century, innovators began to accelerate the technology toward portability, with an emphasis on a continued reduction in the size and weight of such electronic devices. A small, portable device for playing a 10-inch phonograph, having dimensions approximately equal to that of a modern CD player, was later developed and marketed boasting many new and novel features, one being of an overall dimension providing the ability to carry the portable device within a small hand-bag or pouch.

Modern technology in the field of small portable electronic musical devices, similar to those previously described, soon advanced to the introduction of a small, personal, stereo cassette tape player, later updated with a radio tuner and designed to be used with small personal stereo headphones. A portable compact disc player was subsequently introduced providing the average user the ability to play one compact disk at a time and listen to the output also by the use of small personal stereo headphones.

The feature of portability offered by devices such as described, and similar devices, quickly gained popularity by providing an easier means for bringing the device to a picnic or camping trip for example. It soon became apparent, however, that a method and apparatus was needed by increasingly active and mobile societies to provide not only the ability to securely and easily transport a musical device to a destination but to use such a device during travel while simultaneously performing some other physical activity. Such portability was particularly needed by those wishing to listen to music or other audio sources while walking, jogging, riding a bicycle, or while performing some other similar physical activity requiring the hands to be substantially free.

To accommodate the increasing desire for hands-free portability in modern electronic musical devices such as stereo cassette players or portable CD players, a variety of belt clips, carrying cases and protective covers have been developed along with the technology, to be used with the many different types of portable musical electronic devices being developed. One common method for hands-free carrying and simultaneous use of portable electronic devices such as described, is by attaching a clip to the back of the device and clipping the attached device to the user's belt or along the belt line of the clothing, usually at or near one side of the body. Another common method is the use of a carrying case having versions developed for use with most current cassette players or portable CD players, consisting of a pouch or compartment, usually with a closing flap or other closure apparatus that is commonly secured with Velcro material or snaps. The pouch or compartment is attached on either opposing side to straps designed to rest on the circumference of the users hips and attached to each other at the opposite end of the body using clasps, buckles, or some other common method of attachment. Such a hip strap is usually adjusted by means of adjusting buckles or clips, or may be manufactured using a variety of flexible stretchable material such as neoprene or some other synthetic material with similar qualities. A small zippered pouch, commonly referred to informally as a fanny pack, suspended by a belt around the waist is also a common method chosen by many users to carry and use their personal electronic device during physical activity.

There are several problems encountered using conventional methods such as described above for hands-free carrying and use of personal portable electronic devices. For example, a belt clip attached to the back of a device and secured to the belt or clothing, while allowing free and unfettered access to device itself, leaves the device vulnerable to bumping and other undesirable contact with other objects during activity, causing undue risk of damage. A device attached to the belt or clothing in this manner, having no cover or protective casing, can also be damaged or wear prematurely due to excessive ultraviolet exposure or frequent contact with outside elements such as dust or rain. Such a device is also more easily dislodged by inadvertent contact with another object, or the frequent motion of a jogger or bicyclist for example.

An example of another problem encountered with the above-described method utilizing a pouch or compartment attached to an adjustable or elastic belt suspended by the hip, is that the flap holding the device within the compartment, often secured with a snap or sometimes Velcro, is prone to becoming unfastened due to excessive motion or contact with another object, increasing the likelihood of the device following out of the compartment. This is especially true for those carriers having a compartment that holds the device in a horizontal position. Wearing a device on the hip in such a manner is awkward and uncomfortable for many users depending on the activity pursued during use of the device. Most the various belt carriers and zippered belt pouches such as described above also have an inherent problem of providing little or no user access to function controls, earphone jacks, displays and the like.

What is clearly needed is an improved method and apparatus for securing and transporting a personal electronic device such as described above, allowing a user easy access, by placement of the secured device in a more convenient and protected location, while at the same time allowing for easier access to function controls and other components of the device. Such a method and apparatus, by having a more secure method of attachment to the user and a more secure means of containing the device within the compartment, will provide the user with increased mobility in many situations and enhance protection of the device from damage due to the elements and contact with other objects.

SUMMARY OF THE INVENTION

In a preferred embodiment of the present invention a personal carrier for carrying an electronic device in front of a user's upper body is provided, comprising a carrier body having an opening with a closure for inserting and withdrawing the electronic device; a body strap system attached to opposite edges of the carrier body, for passing around a user's upper body, placing the body against the user's front, upper body area; and a shoulder strap system attaching to the carrier body, having a portion passing over each of a user's shoulders, and joining to the body strap system at a position in the user's mid-back area with the carrier body positioned in the user's front, upper body area.

In some embodiments one or both of the body strap and shoulder strap systems comprise adjustable mechanisms for adjusting the length of the strap systems for different users, and there may also be quick-release mechanisms for opening the straps for donning and removing the carrier from the user's body.

In various embodiments the carrier body comprises one or a combination of cloth, flexible plastic, rigid plastic or rigid material, and may be water and weatherproof, including the closure. In some embodiments there is a plastic, transparent window, enabling a user to see and operate controls of an electronic device within the carrier body. There may also be an opening for passing a cord of a headset through a wall of the body. In alternative embodiments the body comprises a female headphone jack implemented on one surface, with a connecting cable and a male jack within the body, such that a user may connect the inside jack to the female jack of an electronic device in the carrier body, and plug in a headphone set from outside the carrier body. Further some embodiments have protective padding.

In an other aspect of the invention a method for carrying an electronic device on a person is provided, comprising the steps of (a) placing the device in a carrier having a carrier body a closure for inserting and withdrawing the electronic device, a body strap system attached to opposite edges of the carrier body, for passing around a user's upper body, placing the body against the user's front, upper torso area, and a shoulder strap system attaching to the carrier body, having a portion passing over each of a user's shoulders, and joining to the body strap system at a position in the user's mid-back area with the carrier body positioned in the user's front, upper body area; (b) positioning the carrier body at the upper front area of the person's upper torso; and (c) passing the body straps around the person and the shoulder straps over the person's shoulders, securing the carrier body and electronic device against the person's upper front torso area.

The unique and novel carrier of the present invention, described in enabling detail in several exemplary embodiments below, for the first time provides a carrier for active persons and sports enthusiasts that can be easily worn and used with such as a CD player while the user is engaged in other activity, like riding a bicycle, while still providing a secure and comfortable situation for the user and the device.

BRIEF DESCRIPTION OF THE DRAWING FIGURES

DESCRIPTION OF THE PREFERRED EMBODIMENTS

Figure 1:
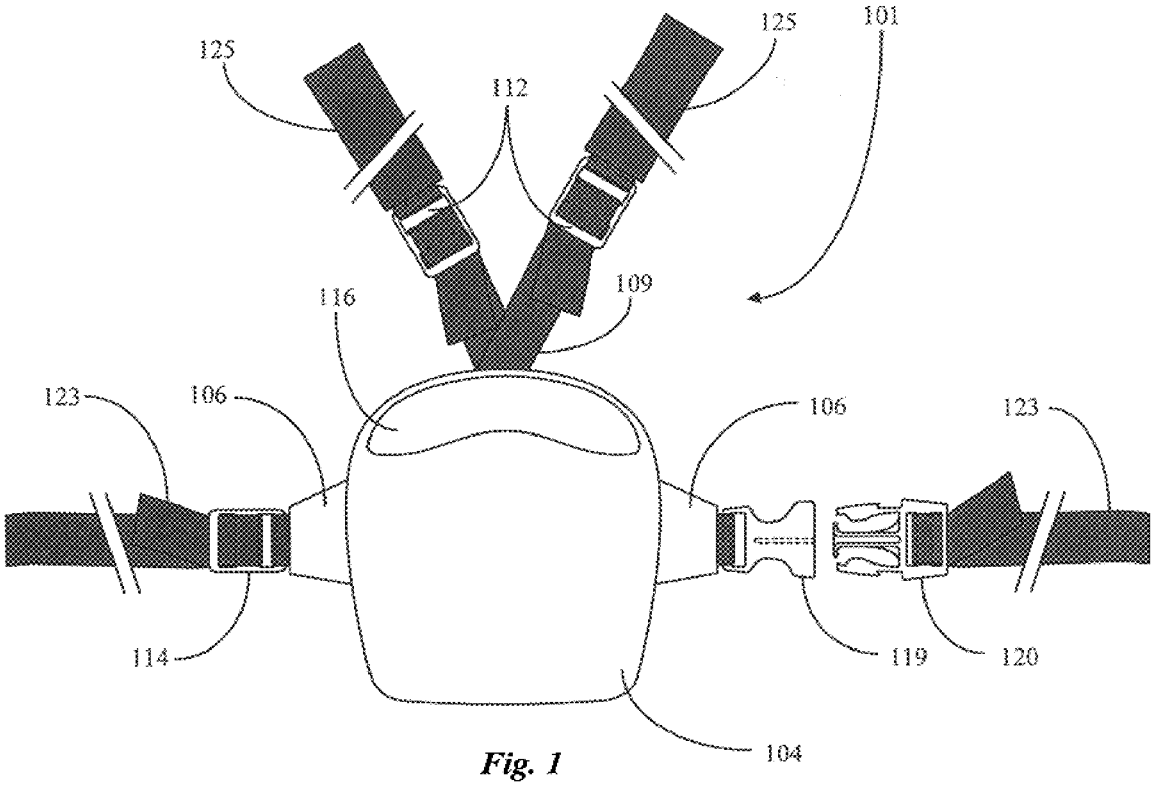
FIG. 1 is a front elevation view of portable electronic device carrier according to a preferred embodiment of the present invention.

FIG. 1 is a front view of portable electronic device carrier according to a preferred embodiment of the present invention. CD carrier 101 is provided in this embodiment being of the shape and circumference similar to and slightly larger than that of a current-model portable compact disk player for which it is intended. Window 116, positioned in this embodiment at the upper center portion of carrier body 104, where the function controls reside in a majority of portable compact disk players, provides visual and manipulative access to the carried device's controls. Window 116 is manufactured of resilient, clear plastic material resistant to scratches or tears, and is provided to allow a user both visual and manual access to the CD player held within body 104. The nature of the flexible material is such that a user can press buttons, for example, on an enclosed device, through the plastic window material.

The size, shape and location of a window such as window 116 can vary in other alternative embodiments depending on the location of the device functions to be accessed. It still other alternative embodiments a means may be incorporated into a carrier such as carrier 101 by which a user can place and install a custom cut window to cover function controls in various locations, using materials and methods known and common in the art.

Flaps 106, attached on each opposite side of body 104 in this embodiment provide a stable and secure interface between body 104 and the straps such as body straps 123 and shoulder straps 125. Body straps 123 are attached and secured to flaps 106 and can use various methods known in the art such as a clasp device comprising a clasp socket 119 and clasp 120 as shown here, or an adjustable securing method such as is also shown here using adjustable strap buckle 114. Any variety or combination of clasps, buckles adjustable or not, or other methods of securing, body straps and shoulder straps to the body of a carrier such as carrier 101 can be used in various alternative embodiments, as it is the object of the present invention to enable new and novel positioning and functionality of a carrier such as carrier 101 utilizing straps and securing methods common in the art.

The means for securing shoulder straps 125 to body 104 is provided by top strap 109, enabling a connection point for the ends of both shoulder straps 125 by the V-shape and dual ends of top strap 109. Conventional buckles 114 are shown in this view to be the means for securing shoulder straps 125 to top strap 109, but in other alternative embodiments, as with the securing method used for body straps 123, the different types of conventional securing methods used can vary greatly.

Figure 2:
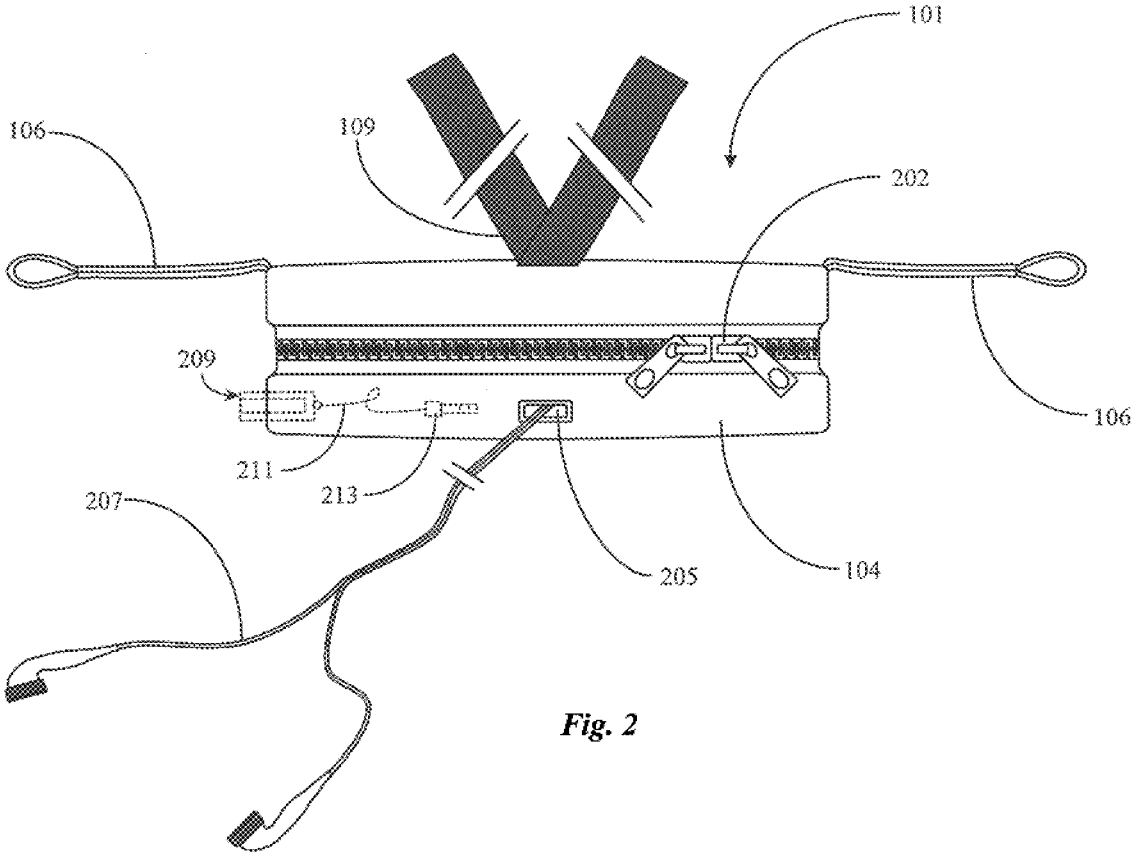
FIG. 2 is a top view of the portable electronic device carrier of FIG. 1 and earphones according to an embodiment of the present invention.

FIG. 2 is a top view of carrier 101 of FIG. 1 and includes a set of earphones 207 according to an embodiment of the present invention. Earphones 207, also conventional and commonly used in various electronic devices, are shown in this view only to illustrate new novel improvements for carrier 101. Opening 205 is provided in this embodiment to enable the passage of the connecting end of earphones such as earphones 207 in order to allow a user to connect the earphones to the device and listen to the output with the device completely enclosed within the carrier. As with window 116 of FIG. 1, opening 205 can vary in size, shape and location in alternative embodiments, and may be incorporated into another embodiment and installed in a location determined by the user using conventional methods and materials. In an alternative embodiment an intermediate earphone jack 209 (shown in phantom in FIG. 2) is provided in a surface of body 104, which is in turn internally connected by a wire extension 211 within carrier 101 and a male jack 213 to an appropriate earphone female jack of a device within the carrier. Such an arrangement would allow a user to plug the connector end of the earphones directly into the external jack of the body of the CD carrier without the need to open and close the compartment containing the device. This embodiment is particularly useful for a model of the carrier wherein the body is of waterproof material, so weatherproofing can be secure. It is to be understood that when the earphone jack 209 is used with the body 104, opening 205 is not used and when opening 205 is used with the body 104, earphone jack 209 is not used.

Strap 109 can be seen in this view located at the top rear portion of body 104, and flaps 106, shown here to provide a clearer view without buckles or clasps as in FIG. 1, can be seen at their side locations. Body 104 in this embodiment can be seen in this view to comprise two half sections, the rear section with flaps 106 attached, connected at the center to a front section by an installed conventional zipper 202. Zipper 202 in this embodiment is a preferred method of closure for securing a device such as a CD player within the compartment formed by the two halves of body 104. Zipper 202 extends nearly around the entire circumference of body 104 in one embodiment, extending to the bottom of body 104 to a point slightly less than where the ends would meet. Such a closure system enables a user to completely open zipper 202, and significantly spread the two halves of body 104, while still connected at the bottom, so that easy access to the device within can be achieved.

In alternative embodiments many different variations of closure systems can be utilized such as Velcro, snaps, or some other conventional method. The location of length of zipper 202, or other closure systems in other alternative embodiments, can also vary greatly. For example, a closure system may be located either at the rear or front portion of the body of the CD carrier creating a flap when opened. In another example the closure system utilized may extend to a much shorter length around the circumference of the body of the CD carrier, and so on.

Figure 3:
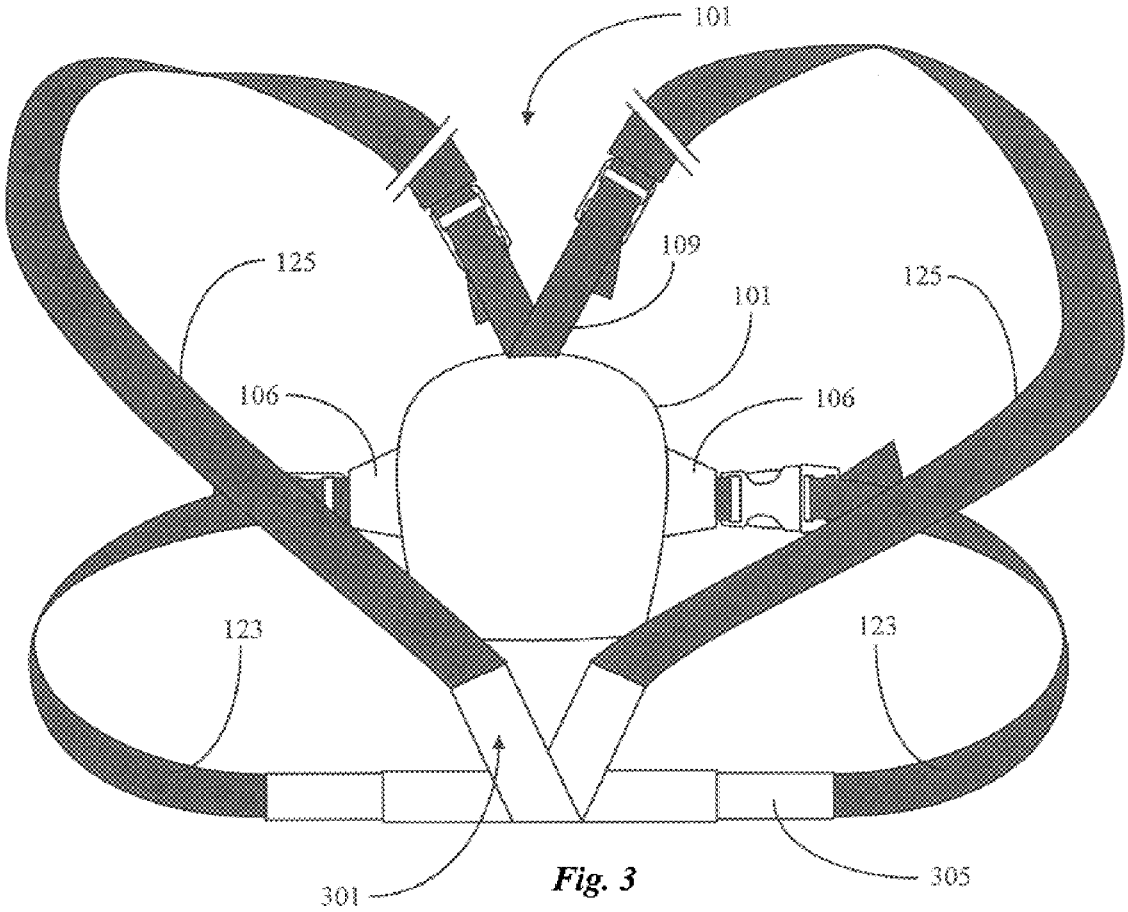
FIG. 3 is a back view of the portable electronic device carrier of FIG. 1 with shoulder and belt straps according to an embodiment of the present invention.

FIG. 3 is a rear view of CD carrier 101 of FIG. 1 with shoulder straps 125 and body straps 123 installed according to an embodiment of the present invention. Strap section 301 is provided in this embodiment as a junction point between the ends of shoulder straps 125 and body straps 123, a point that is at the mid to lower section of the back of a user when used according to the preferred embodiment. Section 301 in this embodiment is manufactured of stretchable fabric to assist in providing a snug fit when properly adjusted on the body of the user, and has a width of approximately two inches in each of the four extensions, a width determined by the inventor to provide increased comfort to the user when properly worn and adjusted. Strap sections 305 in this embodiment, also of a width similar to that of section 301, can be seen attached to each of the lower ends of section 301 providing a sturdy interface connecting the ends of body straps 123 to lower ends of section 301. Both attached ends of body straps 123 can be seen extending from the lower sections 305, forward and around towards the rear of CD carrier 101 where they are connected by a variety of means previously described to flaps 106 on either side of body 104 of CD carrier 101.

In addition to the above, the ends of shoulder straps 125, both connected to the ends of the upper elastic portions of section 301 and extending up and over body straps 123, are than connected to both ends of the Y-shaped strap 109 similarly connections between the straps 123 and flaps 106. With CD carrier 101 being worn by a user with straps configured as shown in this view according to this embodiment of the present invention, the body of CD carrier 101 is suspended in a convenient location in front of the user's body near the center portion the users chest by shoulder straps 125 which rest comfortably on the shoulders of the user. By locating body 104 in such a way, increased protection from bumping into other objects during user activity is provided to the CD player or other device within, as compared to conventional carriers or belt clips as previously described in the background section. The location of the suspended body 104 of CD carrier 101 on the user's chest can be altered up or down according to user preference by equally adjusting the length of shoulder straps 125 using any of the adjustable clasps or buckles as previously described. With shoulder straps 125 properly located on the user's shoulders and attached at the front to strap 109 of body 104, both ends of body straps 123 are routed forward around the circumference of the body of the user and connected to flaps 106 of CD carrier 101 similarly to shoulder straps 125.

Additional support to the suspended body 104, as well as overall stability to the strap configuration is provided once the straps are connected and adjusted to the proper circumference as determined by the user. The width of shoulder straps 125 in this embodiment is similar, approximately two inches, to that of strap section 301, also providing increased comfort to the shoulders of the user when properly worn. In other alternative embodiments however, the dimensions of shoulder straps 125, body straps 123, strap sections 301 or 305 can vary in width, length, or thickness as determined by different uses or applications. Additionally, any or all of the straps utilized in this or other embodiments can vary in manufacture and materials. For example, elasticity could be manufactured into any of the straps or portions thereof, or may be omitted altogether.

In various embodiments of the present invention body 104 may be implemented in a wide variety of materials. In one embodiment the material is soft but durable cloth, such as canvas duck material. In other embodiments the material may be flexible polymer material such one of many kinds of resilient plastic materials. In still other embodiments the body material may be rigid, such as a rigid polymer, or even metal, to provide maximum protection for an electronic player, such as a CD player carried in the carrier. In alternative embodiments padding may be provided within body for additional protection of electronic devices carried, combined with either soft or rigid body.

A carrier such as described herein can be designed in other alternative embodiments to accommodate a variety of different devices varying in size and shape, and may be manufactured using a variety of methods and materials. It is the object of the present invention to provide an improved method and apparatus for carrying such a device while providing new and novel features not existing in conventional art. A method and apparatus such as previously described places the device being carried in a convenient and protected location decreasing the likelihood of undesired contact with other objects during user activity. The size, shape, materials and method of manufacture may vary greatly in different embodiments utilizing the improved method and apparatus of the present invention. In an alternative embodiment of the invention, for example, the shoulder straps may be implemented to pass over a user's shoulders and fasten again directly to the carrier body, instead of to the body straps (123) as illustrated in the figures. In still another alternative the shoulder straps may comprise a loop supported on the back of the user's neck rather than re-attaching to either the body straps or the carrier.

It will be apparent to one with ordinary skill that the method and apparatus of the present invention may be practiced in many different situations and therefore may be modified in dimensional size and shape to fit any user situation. For these reasons the method and apparatus of the present invention should be afforded the broadest possible scope. The spirit and scope of the present invention should be limited only by the claims that follow.

What is claimed is:

1. A personal carrier for carrying an electronic device in front of a user's upper body, comprising:

a carrier body having an opening with a closure for inserting and withdrawing the electronic device;

a body strap system attached to opposite edges of the carrier body, for passing around a user's upper body, placing the carrier body against the user's front, upper body area;

a shoulder strap system attaching to the carrier body, having a portion passing over each of a user's shoulders, and joining to the body strap system at a position in the user's mid-back area with the carrier body positioned in the user's front, upper body area; and an intermediate jack apparatus implemented through a surface of the carrier body, the intermediate jack having a mechanism for connecting internally to an earphone jack of a device enclosed in the carrier body, and presenting a female jack externally for accepting a male earphone jack.

2. The carrier of claim 1 the mechanism for connecting internally comprises a cable extending from the intermediate jack internally, and terminating in a male jack for engaging an earphone jack of an enclosed device.

3. The carrier of claim 2 wherein one or both of the body and shoulder strap systems comprise one or both of adjustable mechanisms for adjusting the length of the strap systems for different users, or quick-release mechanisms for opening the straps for donning and removing the carrier from the user's body.

4. The carrier of claim 1 wherein the carrier body comprises one or a combination of cloth, flexible plastic, rigid plastic or rigid material.

5. The carrier of claim 1 wherein the closure is water and weatherproof.

6. The carrier of claim 1 wherein the body comprises a plastic, transparent window, enabling a user to see and operate controls of an electronic device within the carrier body.

7. The carrier of claim 1 further comprising protective padding within the body for protecting an electronic device.

8. A method for carrying an electronic device on a person, comprising the steps of:

(a) placing the device in a carrier having a carrier body with a closure for inserting and withdrawing the electronic device, a body strap system attached to opposite edges of the carrier body, for passing around a user's upper body, placing the body against the user's front, upper torso area, a shoulder strap system attaching to the carrier body, having a portion passing over each of a user's shoulders, and joining to the body strap system at a position in the user's mid-back area with the carrier body positioned in the user's front, upper body area, and an intermediate jack implemented in a surface of the carrier body, the intermediate jack having a mechanism for connecting internally to an earphone jack of a device enclosed in the carrier body, and presenting a female jack externally for accepting a male earphone jack;

(b) engaging the internally-connecting mechanism with an earphone output of the device;

(c) positioning the carrier body at the upper front area of the person's upper torso;

(d) passing the body straps around the person and the shoulder straps over the person's shoulders, securing the carrier body and electronic device against the person's upper front torso area; and (e) plugging an earphone jack into the externally-presented female jack of the intermediate jack apparatus.

* * * * *